US010648112B2

(12) United States Patent
Chang et al.

(10) Patent No.: US 10,648,112 B2
(45) Date of Patent: May 12, 2020

(54) CLOTH WASHING DEVICE

(71) Applicants: Mircoson Co., Ltd., New Taipei (TW); Kuei-Feng Chen, Taipei (TW); Ming-Chi Chang, New Taipei (TW)

(72) Inventors: Ming-Chi Chang, New Taipei (TW); Kuei-Feng Chen, Taipei (TW); Jhen-Long Chen, New Taipei (TW)

(73) Assignees: Mircoson Co. Ltd., New Taipei (TW); Kuei-Feng Chen, Taipei (TW); Ming-Chi Chang, New Taipei (TW)

( * ) Notice: Subject to any disclaimer, the term of this patent is extended or adjusted under 35 U.S.C. 154(b) by 193 days.

(21) Appl. No.: 15/798,667

(22) Filed: Oct. 31, 2017

(65) Prior Publication Data

US 2019/0127899 A1 May 2, 2019

(51) Int. Cl.

| | |
|---|---|
| ***D06F 11/00*** | (2006.01) |
| ***D06B 23/02*** | (2006.01) |
| ***D06B 3/20*** | (2006.01) |
| *D06B 1/14* | (2006.01) |

(52) U.S. Cl.

CPC ..... *D06F 11/00* (2013.01); *D06B 3/20* (2013.01); *D06B 23/023* (2013.01); *D06B 1/14* (2013.01)

(58) Field of Classification Search

CPC .. D06F 11/00; D06B 3/20; D06B 3/10; D06B 3/04

See application file for complete search history.

(56) References Cited

U.S. PATENT DOCUMENTS

| | | | | | |
|---|---|---|---|---|---|
| 2,579,563 | A * | 12/1951 | Gallinger | D06B 17/02 | 68/5 D |
| 2,721,465 | A * | 10/1955 | Walmsley | D06B 3/10 | 68/184 |
| 3,019,630 | A * | 2/1962 | Fleissner | D06B 5/04 | 68/15 |
| 4,070,878 | A * | 1/1978 | Valls | D06B 3/201 | 68/205 R |
| 4,310,013 | A * | 1/1982 | McClaskey | F04F 10/00 | 137/145 |
| 5,230,570 | A * | 7/1993 | Bursey, Jr. | F16C 33/3831 | 384/527 |
| 10,472,756 | B2 * | 11/2019 | Ronchi | D06B 1/16 | |

* cited by examiner

*Primary Examiner* — Joseph L. Perrin
*Assistant Examiner* — Kevin G Lee
(74) *Attorney, Agent, or Firm* — Alan D. Kamrath; Karin L. Williams; Mayer & Williams PC

(57) ABSTRACT

A cloth washing device contains a washing machine and a fiber opener. The washing machine includes multiple transmission rollers arranged on water and multiple bearings fixed in the water. The fiber opener includes multiple transmission rollers arranged on the water, multiple bearings fixed in the water, and at least two mesh wheels arranged in the water. The fiber opener is mounted behind the washing machine, and a cloth is delivered between the washing machine and the fiber opener by way of the multiple transmission rollers and the multiple bearings of the washing machine and the fiber opener and the least two mesh wheels.

3 Claims, 3 Drawing Sheets

CLOTH WASHING DEVICE

BACKGROUND OF THE INVENTION

Field of the Invention

The present invention relates to a cloth washing device which washes cloth cleanly by way of buoyant force in water so as to eliminate tension as the cloth is moved out of the water.

Description of the Prior Art

A cloth is formed in shrinking, oil removing, fiber opening, drying, and cutting processes, wherein each process is executed independently. In other words, after the cloth is processed in one processing station, it is delivered to next processing station.

A part of the cloth is processed in the oil removing and fiber opening processes in water, so tension is produced and dirt moves back onto the cloth when the cloth moves out of the water, thus increasing a complexity of the machine's configuration, and requiring that the cloth be washed repeatedly.

To improve above-mentioned problems, the water storage level is decreased so as to reduce the tension, however, still the cloth cannot be washed so as to be clean.

The present invention has arisen to mitigate and/or obviate the afore-described disadvantages.

SUMMARY OF THE INVENTION

The primary objective of the present invention is to provide a cloth washing device which washes cloth cleanly by way of multiple bearings in water so as to eliminate tension.

Another objective of the present invention is to provide a cloth washing device which eliminates the tension so as to decrease the complexity of the machine configuration, washing cost, and labor consumption.

To achieve above-mentioned objectives, a cloth washing device provided by the present invention contains a washing machine and a fiber opener.

The washing machine includes multiple transmission rollers arranged on the water and multiple bearings fixed in the water. The fiber opener includes multiple transmission rollers arranged on the water, multiple bearings fixed in the water, and at least two mesh wheels arranged in the water. The fiber opener is mounted behind the washing machine, and a cloth is delivered between the washing machine and the fiber opener by way of the multiple transmission rollers, the multiple bearings of the washing machine and the fiber opener, and the least two mesh wheels.

Preferably, each of the multiple bearings has two opposite discs between which multiple circular cylinders are separately mounted, and each of the circular cylinders rotates, wherein each of the two opposite discs has a fixing shaft mounted on a central position thereof.

Preferably, a material feeding apparatus is arranged in front of the washing machine and is configured to supply the cloth.

Preferably, the washing machine includes an inlet, and the fiber opener includes an outlet lower than and opposite to the inlet.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

A cloth washing device in accordance with a preferred embodiment of the present invention is employed in an oil removing process and a fiber opening process by way of buoyant force in water so as to eliminate tension as the cloth is moved out of the water.

Figure 1:
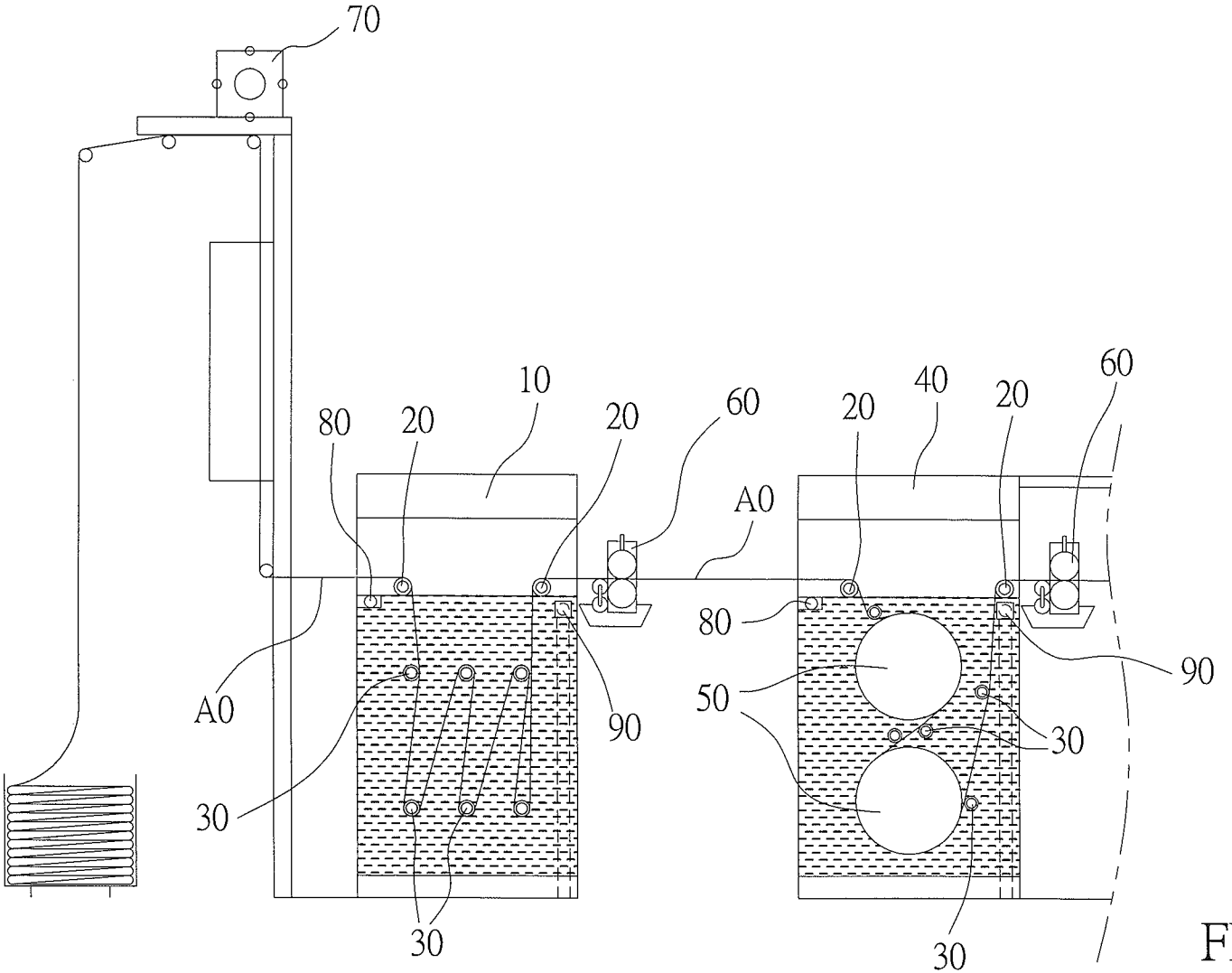
FIG. 1 is a side plane view showing the assembly of a cloth washing device in accordance with a preferred embodiment of the present invention.

With reference to FIG. 1, the cloth washing device includes a washing machine 10 configured to remove oil wax from the cloth and including multiple transmission rollers 20 arranged on the water and multiple bearings 30 fixed in the water, and a fiber opener 40 configured to loosen the cloth and including multiple transmission rollers 20 arranged on the water, multiple bearings 30 fixed in the water, and at least two mesh wheels 50 arranged in the water.

Figure 2:
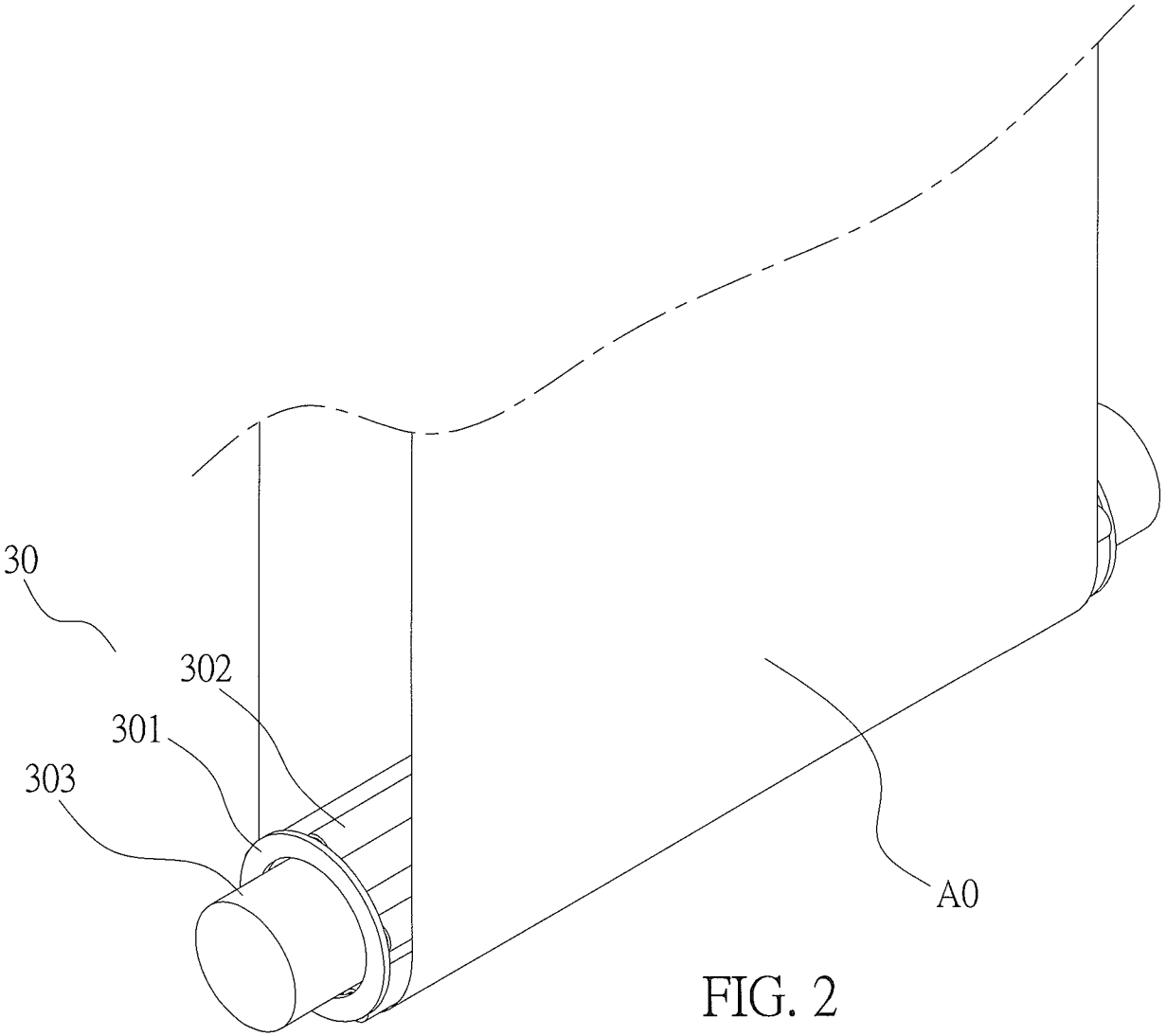
FIG. 2 is a side plan view showing the assembly of a cloth and a bearing of the cloth washing device in accordance with the preferred embodiment of the present invention.

Each of the multiple bearings 30 has two opposite discs 301 between which multiple circular cylinders 302 are separately mounted in a circle arrangement, and each of the circular cylinders 302 rotates, wherein each of the two opposite discs 301 has a fixing shaft 303 mounted on a central position thereof, as shown in FIG. 2.

Among the washing machine 10, the multiple transmission rollers 20, the multiple bearing 30, the fiber opener 40, and the at least two mesh wheels 50 is mounted at least one drying rolling set 60 made of rubber material.

A material feeding apparatus 70 is arranged in front of the washing machine 10 and is configured to supply the cloth.

The washing machine 10 includes an inlet 80, and the fiber opener 40 includes an outlet 90 lower than and opposite to the inlet 80.

Figure 3:
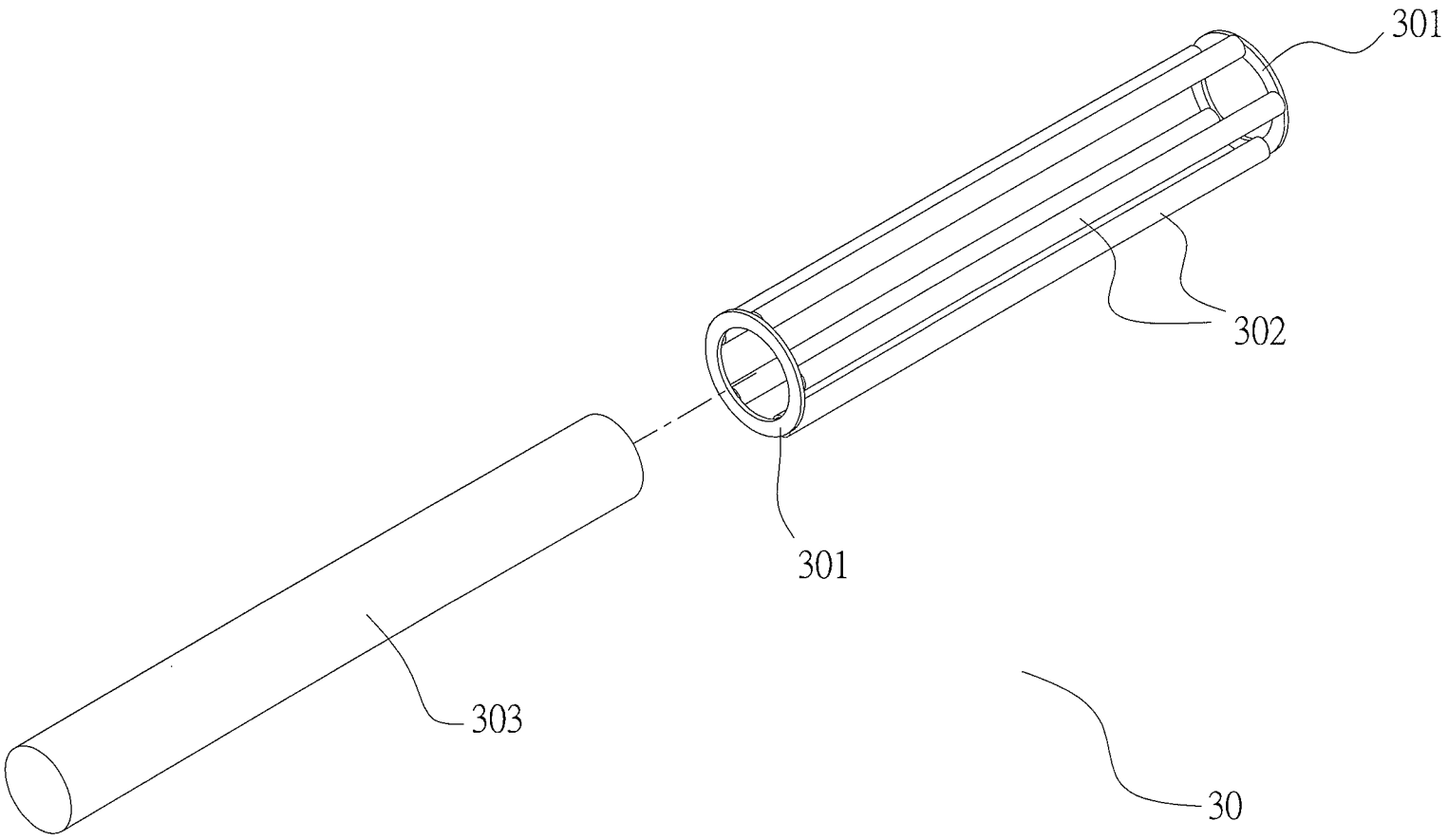
FIG. 3 is a perspective view showing the exploded components of the bearing of the cloth washing device in accordance with the preferred embodiment of the present invention.

In operation, as shown in FIGS. 1-3, the cloth A0 is delivered to the washing machine 10 from the material feeding apparatus 70 and moves in the water to remove oil via a first transmission roller 20 on a first end of the washing machine 10. In addition, a second transmission roller 20 on a second end of the washing machine 10 matches with the first transmission roller 20 to deliver the cloth A0, wherein the cloth A0 moves onto the multiple circular cylinders 302 of the multiple bearings 30 of the washing machine 10 from the first transmission roller 20 via the multiple bearings 30 of the washing machine 10 so that the multiple circular cylinders 302 of the washing machine 10 roll the cloth A0 in the washing machine 10, thus eliminating tension as moving the cloth A0 out of the water by way of buoyant force in the water and avoiding dirt attachment on the cloth A0. Thereafter, the material feeding apparatus 70 conveys the cloth A0 to the multiple transmission rollers 20 of the fiber opener 40 like the multiple transmission rollers 20 of the washing machine 10, and among the multiple bearings 30 of the fiber opener 40 are arranged the at least two mesh wheels 50 so as to loosen the cloth A0 and to eliminate the tension in the water by matching with the multiple bearings

30 in the water. Thereby, the multiple transmission rollers 20 reduce loading of pull force by using the buoyant force in the water, and the multiple bearings 30 in the water mate with the multiple transmission rollers 20 so that the washing machine 10 and the fiber opener 40 operate cooperatively and synchronous.

Two drying rolling sets 60 are fixed behind the washing machine 10 and the fiber opener 40 respectively so as to roll and dry the cloth A0 moving out of the washing machine 10 and the fiber opener 40, wherein a size of each of the two drying rolling sets 60 is large or small, and each drying rolling set 60 is made of rubber material.

The washing machine 10 includes the inlet 80, and the fiber opener 40 includes the outlet 90 lower than and opposite to the inlet 80 so that the dirt flows to the outlet 90 quickly while starting water supply, thus avoiding dirty residue. Preferably, detergents are added into the water in low or high temperature to eliminate oil and dirt quickly.

While various embodiments in accordance with the present invention have been shown and described, it is clear to those skilled in the art that further embodiments may be made without departing from the scope of the present invention.

What is claimed is:

1. A cloth washing device comprising:

a washing machine including multiple washing machine transmission rollers arranged on water and multiple washing machine bearings fixed in the water; and a fiber opener including multiple fiber opener transmission rollers arranged on water, multiple fiber opener bearings fixed in the water, and at least two mesh wheels arranged in the water, wherein the fiber opener is mounted behind the washing machine, and a cloth is delivered between the washing machine and the fiber opener by way of the multiple washing machine transmission rollers, multiple fiber opener transmission rollers, and the multiple washing machine bearings and the multiple fiber opener bearings and the least two mesh wheels, and wherein each of the multiple washing machine bearings and the multiple fiber opener bearings has two opposite discs between which multiple circular cylinders are separately mounted, and each of the circular cylinders rotates, wherein each of the two opposite discs has a fixing shaft mounted on a central position thereof.

2. The cloth washing device as claimed in claim 1, wherein a material feeding apparatus is arranged in front of the washing machine and is configured to supply the cloth.

3. The cloth washing device as claimed in claim 1, wherein the washing machine includes an inlet, and the fiber opener includes an outlet lower than and opposite to the inlet.

* * * * *